US008118664B2

(12) United States Patent
Johnson

(10) Patent No.: US 8,118,664 B2
(45) Date of Patent: Feb. 21, 2012

(54) METHOD OF AWARDING PRIZES FOR JACKPOT AND GAMING MACHINES BASED ON AMOUNT WAGERED DURING A TIME PERIOD

(75) Inventor: Steven Brian Johnson, Acacia Ridge (AU)

(73) Assignee: IGT, Reno, NV (US)

( * ) Notice: Subject to any disclaimer, the term of this patent is extended or adjusted under 35 U.S.C. 154(b) by 0 days.

(21) Appl. No.: 12/978,772

(22) Filed: Dec. 27, 2010

(65) Prior Publication Data

US 2011/0092278 A1 Apr. 21, 2011

Related U.S. Application Data

(62) Division of application No. 11/236,180, filed on Sep. 26, 2005, now Pat. No. 7,883,407, which is a division of application No. 10/049,317, filed as application No. PCT/AU00/00948 on Aug. 9, 2000, now Pat. No. 6,966,834.

(30) Foreign Application Priority Data

Aug. 9, 1999 (AU) ..... 43453/99

(51) Int. Cl.
*A63F 9/24* (2006.01)

(52) U.S. Cl. ..... 463/21

(58) Field of Classification Search ..... 463/21
See application file for complete search history.

(56) References Cited

U.S. PATENT DOCUMENTS 4,837,728 A 6/1989 Barrie et al.
5,116,055 A 5/1992 Tracy
5,477,952 A 12/1995 Castellano et al.
5,505,461 A 4/1996 Bell et al.
5,533,727 A 7/1996 DeMar
5,564,700 A 10/1996 Celona
5,569,082 A 10/1996 Kaye
5,580,309 A 12/1996 Piechowiak et al.
5,611,730 A 3/1997 Weiss
5,743,798 A 4/1998 Adams et al.
5,829,748 A 11/1998 Moore, Jr.

(Continued)

FOREIGN PATENT DOCUMENTS

AU 9213023 3/1992

(Continued)

OTHER PUBLICATIONS

Scarne, John, Scarne's New Complete Guide to Gambling, 1961, Simon & Schuster, pp. 165-267.

(Continued)

*Primary Examiner* — Corbett B Coburn
(74) *Attorney, Agent, or Firm* — K&L Gates LLP

(57) ABSTRACT

Periodic prize draws are conducted by a jackpot controller in a gaming system having one or more electronic gaming devices. The probability of each electronic gaming device winning a particular prize draw is dependent upon the amount wagered on that gaming machine during a period preceding that prize draw. The prize may be a progressive jackpot which comprises an initial starting value and a contribution from the amounts wagered on the electronic gaming devices. If an electronic gaming device wins a prize draw, its player may be granted a feature game to determine the actual prize. Jackpots are suspended pending the completion of the feature game. The probability that a gaming device will win the prize draw, or the relative win probabilities of the gaming devices, may be displayed graphically.

23 Claims, 4 Drawing Sheets

U.S. PATENT DOCUMENTS

| | | | |
|---|---|---|---|
| 5,855,515 | A | 1/1999 | Pease et al. |
| 5,855,575 | A | 1/1999 | Solomon et al. |
| 5,885,158 | A | 3/1999 | Torango et al. |
| 5,984,779 | A | 11/1999 | Bridgeman et al. |
| 6,017,032 | A | 1/2000 | Grippo et al. |
| 6,102,799 | A | 8/2000 | Stupak |
| 6,146,273 | A | 11/2000 | Olsen |
| 6,168,521 | B1 | 1/2001 | Luciano et al. |
| 6,210,277 | B1 | 4/2001 | Stefan |
| 6,231,445 | B1 | 5/2001 | Acres |
| 6,238,288 | B1 | 5/2001 | Walker et al. |
| 6,254,483 | B1 | 7/2001 | Acres |
| 6,296,569 | B1 | 10/2001 | Congello, Jr. |
| 2001/0049303 | A1 | 12/2001 | Found |

FOREIGN PATENT DOCUMENTS

| | | |
|---|---|---|
| AU | 704365 | 4/1997 |
| AU | 697582 | 2/1998 |
| AU | 721968 | 6/1998 |
| AU | 757903 | 10/1998 |
| AU | 728788 | 7/1999 |
| AU | 753102 | 11/1999 |
| AU | 760617 | 1/2000 |
| AU | 754819 | 3/2000 |
| AU | 200030250 | 7/2000 |
| AU | 20053686 | 8/2000 |
| AU | 776008 | 10/2000 |
| EP | 0534718 | 3/1993 |
| EP | 0787026 | 7/1999 |
| GB | 2201279 | 8/1988 |
| WO | WO 99/03078 | 1/1999 |
| WO | WO 99/21630 | 5/1999 |
| WO | WO 00/22585 | 4/2000 |
| WO | WO 00/32286 | 6/2000 |
| WO | WO 01/15790 | 3/2001 |

OTHER PUBLICATIONS

Federal Court of Australia: *Neurizon Pty. Ltd* v. *Jupiters Limited* (with Corrigendum dated Oct. 21, 2004 FCA 1012 (Aug. 5, 2004).

Federal Court of Australia: *Neurizon Pty. Ltd*. (CAN 077 012 376) v *LTH Consulting and Marketing Services Pty Ltd* (CAN 061 363 139) [2002] FCA 1547 (Dec. 13, 2002).

Federal Court of Australia: *Jupiters Ltd* v *Neurizon Pty. Ltd*. [2005] FCAFC 90 (May 23, 2005).

Bueschel; Lemons, Cherries, and Bell-Fruit-Gum, Royal Bell Books, 1995, 30, 39, 40, 43, 44, 90, 248, 287 and 288.

Christensen; Slot Machines—A Pictorial Review, Vestal Ress, 1972, 2, 3, 118 and 119.

UK Search Report, dated Feb. 27, 2003 for Application No. GB 0202926.2.

METHOD OF AWARDING PRIZES FOR JACKPOT AND GAMING MACHINES BASED ON AMOUNT WAGERED DURING A TIME PERIOD

PRIORITY CLAIM

This application is a divisional of, claims priority to and the benefit of U.S. patent application Ser. No. 11/236,180, filed on Sep. 26, 2005, which is a divisional of, claims priority to and the benefit of U.S. patent application Ser. No. 10/049,317, filed on Feb. 8, 2002, now U.S. Pat. No. 6,966,834, which is a national stage application of PCT/AU00/00948, filed on Aug. 9, 2000, the entire contents of which are each incorporated by reference herein.

BACKGROUND ART

An electronic gaming device (EGD), such as a poker machine, provides its player with the opportunity to win cash or other prizes. To entice more persons to play EGDs and/or to render them more exciting, it is known to link EGDs electronically in a network, with each EGD contributing a proportion of its turnover to a pooled jackpot. The EGDs in a network may be located on one site, or spread over several remote sites. Since a larger number of EGDs contribute to the jackpot, the jackpot can have a higher value and/or be won more often than single machine jackpots.

In a typical progressive linked jackpot system, one or more EGDs contribute a percentage of turnover to a pool (either on a local or external network). Each time an EGD is played, it tests for a particular winning combination. If that combination is achieved, the EGD is awarded the pool. A key aspect of this arrangement is that each game played has the same probability of a jackpot win.

This arrangement has traditionally been used by casinos but its popularity is diminishing due to the introduction of EGDs featuring multiple line and multiple credits per line wagering options. If a player elects to play multiple credits per line, the win probability would no longer be proportional to the wager. That is, the win probability would be the same regardless of the number of credits wagered on the line. This is considered a major disincentive to wagering multiple credits per line. This arrangement also requires the EGD to provide special software which tests for the winning combination. Further, it is difficult to link EGDs of differing base denominations to the same progressive jackpot pool.

Another type of jackpot system is described in Australian patent no. 655801. In this type of jackpot system, one or more EGDs are typically connected to an external Random Jackpot Controller (RJC) via a data network. As each game is played, the RJC adds a proportion of each wager to the external pool. The RJC initially seeds the pool with a starting value. The RJC then selects a random number between the starting value and a predetermined maximum value. As each EGD is played, each EGD informs the RJC of the credits bet and a proportion of the wager is added to the pool. The value of the pool is then compared with the selected random number. If there is a match, the RJC awards the current pool value to that EGD. This arrangement is usually configured to provide relatively small but frequent awards, and has the inherent characteristic that the probability of a win on each EGD increases as the pool increases toward the maximum limit.

However, since the win probability increases as the pool increases towards its predetermined maximum limit, a player playing just after the pool is reset has a lower jackpot win probability than a player playing at a later time when the pool is greater, even though both players may be wagering the same amount. For this reason, this arrangement is generally considered unfair and deterministic. The deterministic nature of this jackpot system has led some gaming authorities to prohibit the inclusion of the pool contributions into the "Return to Player Percentage" (RTP) for taxation calculation purposes, which diminishes the financial appeal of this jackpot system to gaming machine operators.

Yet another type of jackpot system is described in international patent application no. PCT/AU98/00525. In that jackpot arrangement, one or more EGDs are typically connected to an External Feature Game Controller (EFGC) via a communications network. Each EGD informs the EFGC of credits bet and a proportion of the credits bet is added to the external jackpot pool. This pool is typically seeded with a starting value.

As each game is played (and only when a game is played), the EGD tests for the occurrence of a random "win" event whose probability is a function of the credits bet on that particular game. If the EGD detects the random event, the EFGC is informed. The EGD then typically enters a feature game where the winning amount is determined. The EFGC is informed of the win and in some cases will transmit the value of the win to the EGD's credit meter. In other cases, the EGD will be locked up until the jackpot is paid manually by an attendant. The greater the wager per game the greater is the probability of a win on that game.

A disadvantage of this arrangement is that it is not easily applied to an existing EGD installation. Each EGD must be fitted with special software with a means of determining and detecting the random event per game. Alternatively, a communications-based Central Feature Game Controller (CFGC) may theoretically be employed which has a means of determining and testing for the random event per game on behalf of each EGD, based on the credits bet on each game.

Many jurisdictions have mandated the use of specialized communications networks designed to collect EGD data and to provide a means of external control over the EGDs. Some operators of these networks have implemented their own jackpot awarding systems utilizing these networks. These networks however, cannot guarantee that each EGD's data will be collected in synchronization with each EGD's game cycle. Further, many of these communications networks do not even support the collection of "credits bet" data from EGDs. In some cases there may be over 6 games played between data collections. If a CFGC utilized these networks for the collection of the credits bet information for the purpose of centrally determining the random event based on credits bet on each game, there would be a real likelihood that many played games would be missed due to the data collection latency of the communications systems. This would result in those games still contributing to the jackpot pool but with no chance of winning the prize. This makes it impractical to use credits bet per game as a basis for the determination of the random event on a game-by-game basis in a CFGC acting on behalf of each EGD.

A further problem with this jackpot arrangement is that once an EGD enters its feature game for the purpose of determining the actual prize, one of the available pools is always going to be awarded regardless of the feature game outcome. There is no technical barrier to a smart player deferring the playing of the feature game to allow the jackpot pool to increase in value. The longer the player waits, the greater the potential pool increase and the greater the prize. In an extreme example, the player could wait until the feature game is triggered on another contributing EGD, then immediately play the feature game and effectively steal the other player's prize.

It is an object of this invention to provide an improved prize awarding system for a network of EGDs, which overcomes or ameliorates the above described disadvantages or which at least provides a useful alternative.

SUMMARY OF THE INVENTION

This invention relates to a prize awarding system. In particular, the invention is directed to method and apparatus for awarding a prize to players of gaming machines, wherein the probability that the player of a gaming machine will win the prize is dependent upon the amount bet on that gaming machine during an elapsed period.

In one broad form, the invention provides a method of awarding a prize in a gaming system comprising at least one gaming machine, characterized in that the probability of each gaming machine winning the prize is dependent upon at least some of the amount wagered on that gaming machine during an elapsed period.

In the preferred embodiment, prize draws are held periodically. Prior to each prize draw, the probability of each gaming machine winning that draw is calculated.

In another form, the invention provides a gaming system comprising at least one gaming machine; control means connected to the gaming machine(s), the control means being adapted to conduct a series of prize draws in each of which each gaming machine has an opportunity to win a prize on a non-deterministic basis; and means for determining the winning probability of each gaming machine at each prize draw, characterized in that the probability of each gaming machine winning a prize draw is dependent on at least some of the amount wagered on that gaming machine during an elapsed period.

In yet another form, the invention provides a gaming machine having means for effecting a prize draw to award a prize on a non-deterministic basis, and means for determining the probability of the gaming machine winning the prize, characterized in that the probability of the gaming machine winning the prize is dependent on at least some of the amount wagered on the gaming machine during an elapsed period.

Preferably, the probability is related to the total wagered amount recorded during the elapsed period.

The elapsed period is typically a rolling or sliding period of time, preceding each prize draw.

Draws may be held at periodic intervals which are shorter than the sliding period of time. In that case, the amount wagered during the period between draws is calculated on a pro rata basis from the recorded amount of wagers during the predetermined elapsed period.

The prize may suitably be a cash prize, such as a progressive jackpot.

In a further embodiment of the invention, if a gaming machine wins a prize draw, it is awarded a feature game to determine the actual prize or jackpot. All jackpot pools are suspended until the feature game is played Advantageously, the probability of a gaming device winning the prize draw, and/or the relative probabilities of the gaming machines winning the prize draw, are displayed graphically.

The prize awarding system of this invention enables a jackpot or other prize to be awarded on a non-deterministic basis, yet in a fair manner, as the probability that a gaming machine will win the prize depends on the amount of recent betting activity on that gaming machine.

In order that the invention may be more fully understood and put into effect, preferred embodiments thereof will now be described with reference to the accompanying drawings.

DETAILED DESCRIPTION OF PREFERRED EMBODIMENTS

Figure 1:
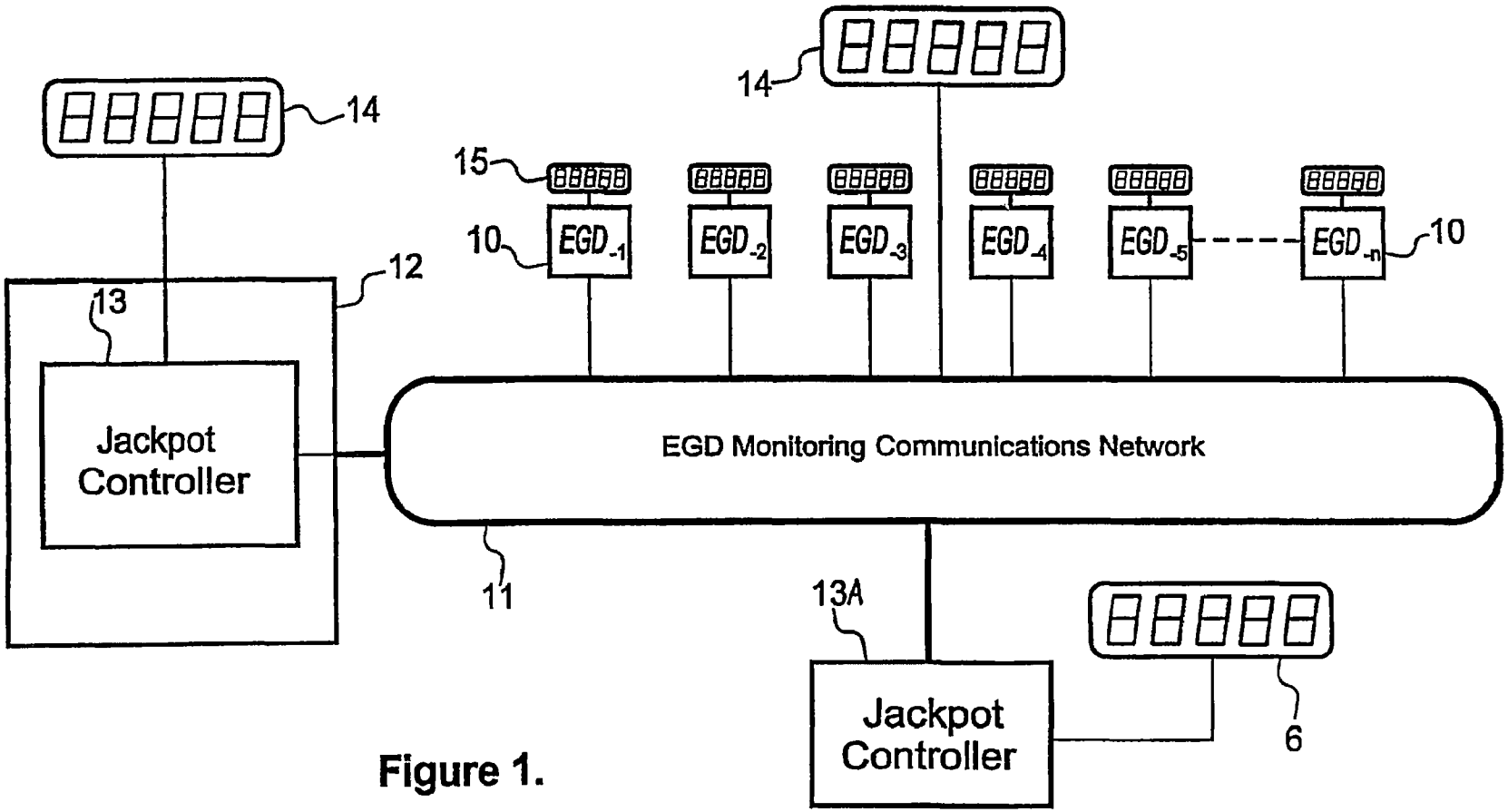
FIG. 1 is a block diagram of a jackpot system for a network of gaming devices.

In one embodiment, illustrated schematically in FIG. 1, a plurality of Electronic Gaming Devices (EGDs) 10 operating in a modern gaming environment are connected to a communications network 11, typically running over RS485, Fibre Optic, Ethernet, or other suitable data transmission cable. The communications network 11 has an EGD monitoring device 12, such as a site controller or polling front-end processor. The EGD monitoring device will be referred to as the monitoring system. The monitoring system 12 collects financial and other information from the EGDs. This information is commonly referred to as "meters".

The monitoring system 12 contains a Special Prize Presentation Controller Task which in this embodiment, is a jackpot controller 13 capable of maintaining one or more jackpot pools. The jackpot controller 13 displays the current value of each jackpot pool on one or more jackpot displays 14. These displays may be remote from the EGDs, either connected to the communications network 11 or to the jackpot controller 13 directly.

The gaming system may optionally include an alternative or additional jackpot controller 13A with its associated display 6. The EGDs may also have local jackpot displays 15 which may be operated by the jackpot controller(s), via the communication network.

The jackpot controller 13 calculates and manages the jackpot pools from the information provided to it by the monitoring system 12. The only meter required by the jackpot controller from the monitoring system is the current value of the turnover meter of each EGD. The turnover meter is represented in local base currency units (e.g. cents). The turnover meter usually indicates the accumulated turnover, e.g. credits bet, since the EGD was commissioned. The jackpot controller calculates from the received turnover meter reading, the change in turnover since the last time the turnover meter was read. This is the primary figure used for all jackpot calculations.

For each jackpot, the jackpot controller maintains a prize pool. This prize pool is a calculated pool, comprising (i) a starting value of the jackpot, and (ii) a proportion, equal to the contribution percentage, of the increased turnover of each EGD contributing to the pool since the last jackpot was won. For example a jackpot pool with a 3% contribution will increase by 3 cents for every dollar wagered on an EGD connected to the jackpot. This pool is normally the prize granted to the winning player when a jackpot is won.

In the jackpot system of this embodiment, the probability of an EGD winning the jackpot is dependent upon the turnover of that EGD over a predetermined elapsed period of time. This period of time is a sliding or rolling "window" of time prior to each jackpot draw.

Every change in turnover meter recorded for an EGD is stored by the jackpot controller with a timestamp. The timestamp indicates the time that the change in turnover meter was recorded. Each recorded change in turnover meter may contain the turnover from multiple game plays. It is possible that there may be no change in turnover meter since the last record, in which case a change in turnover meter of zero cents is recorded. Only turnover recorded within the sliding time window or "Record Period" is used for the purposes calculating the probability of a jackpot win.

For example, Table 1 shows the turnover information recorded for three EGDs for a Record Period equal to the immediately preceding 30-second period. The turnover meters of the EGDs are nominally read approximately once every 10 seconds. The current time for the purpose of the example is 10:29:20. Hence the relevant window of time or Record Period was that period between 10:28:50 and 10:29:20.

As shown in Table 1, EGD 1 had its change in turnover meter recorded approximately every 8 seconds, EGD 2 approximately every 7 Seconds and EGD 3 approximately every 11 seconds. This variation is due to operational variances across machines such as type, model, vintage, manufacturer and network characteristics.

Table 2 shows the changes in turnover meter recorded for the same three EGDs at 10:29:30, i.e. after a further 10 seconds have elapsed. The relevant window of time or Record Period is now that period between 10:29:00 and 10:29:30.

During the further 10 second period, several recorded values aged to a point where-they were greater than 30 seconds old, and were therefore discarded. For each EGD one new change in turnover was recorded. The discarded turnover values are shown in Table 3.

It can be seen from the tables that the rolling Record Period allows for variations in operational characteristics by collating all turnover changes during a sliding period. This allows all machines to have a fairer record of activity than individual change in turnover meter figures. Individual turnover figures per EGD may be recorded at varying frequencies. By running a sliding window any variation in operational characteristics can be normalized.

In this embodiment, the method of determining the winner of a jackpot employs a second time window, known as the Draw Period. The Draw Period is the duration between attempts at awarding the jackpot, or in other words, the duration between opportunities for an EGD to win the jackpot, known as jackpot "draws". To ensure that no turnover change is excluded from the draw processing, the Draw Period can equal, but not exceed the Record Period.

The probability that an EGD will win a jackpot draw depends on a calculated scaling factor. In this embodiment, the scaling factor is based on estimated turnover during the Draw Period which is calculated by taking, for each EGD, the total turnover in the Record Period, and dividing it by the number of Draw Periods per Record Period. (Because a division is involved, any fractional cent of the result is counted as one whole scaling unit). That is, based on actual turnover during the whole Record Period, an estimated or average turnover is calculated for the Draw Period on a pro rata basis. If the turnover is in cents, then the Scaling Factor is the number of cents in the estimated turnover during the Draw Period.

For example, using the data from the EGDs above, if the Record Period is 30 Seconds, and the Draw Period is 10 Seconds, Table 4 shows the calculated Scaling Factor for each EGD for the two draw times given as examples above.

The Scaling Factor determines the probability than an EGD will win the jackpot at a draw time. Namely, each EGD has the same predetermined "base" probability of winning the jackpot, but this is multiplied by the Scaling Factor for that EGD for the relevant draw. Since an EGD can have a varying scaling factor, it also has a varying probability of winning a jackpot draw. This probability is given by the formula:

$$\text{EGD Win Probability} = 1-((1-\text{Fixed Base Probability})^{\textit{Scaling Factor}}).$$

Thus, if the base probability is, say, a 0.0003% chance, the probability of each EGD in Table 4 winning the Jackpot at each of the two draw times is shown in Table 5.

The jackpot draw for each EGD can be conducted by any suitable draw method which has the required overall probability. For example, a random number generator can be used for the draw. A fixed number range is defined, and divided into two separate sections, the winning band and the losing band. A random number is generated over the entire range; if it falls within the winning band the draw is won. If it falls outside the wining band into the losing band, the draw is lost. The winning band is a percentage of the entire number range, which is equal to the desired win probability.

Thus, if the win probability is 0.1400%, and the number range is, say, 0 to 4294967295, the winning band is all the numbers from 0 to 6012954. The losing band is then 6012955 to 4294967295. When calculating the win band size, because division is involved, all results are rounded up to the next whole digit in the range. If the random number generated falls within the winning band and the attempt at awarding the prize succeeds. Otherwise the attempt fails. Table 6 gives the varying win band sizes for the probabilities given in Table 5.

If an EGD wins a draw, the EGD is placed into a winning mode and the prize won is advertised on the displays 14, 15. The act of awarding a prize need not necessarily terminate the draw processing and it is possible for another EGD to be selected as a winner in its draw. If there are multiple winners, the prize pool is preferably paid to the first detected winner and all other winners are awarded the reset or starting value of the pool. Alternatively, the prize pool is apportioned between all the winners.

Table 7 shows the assumptions and configuration options of a typical high win rate, small prize Jackpot Pool.

Table 8 gives the operational characteristics of a jackpot so configured, operating as described by this embodiment.

Figure 2:
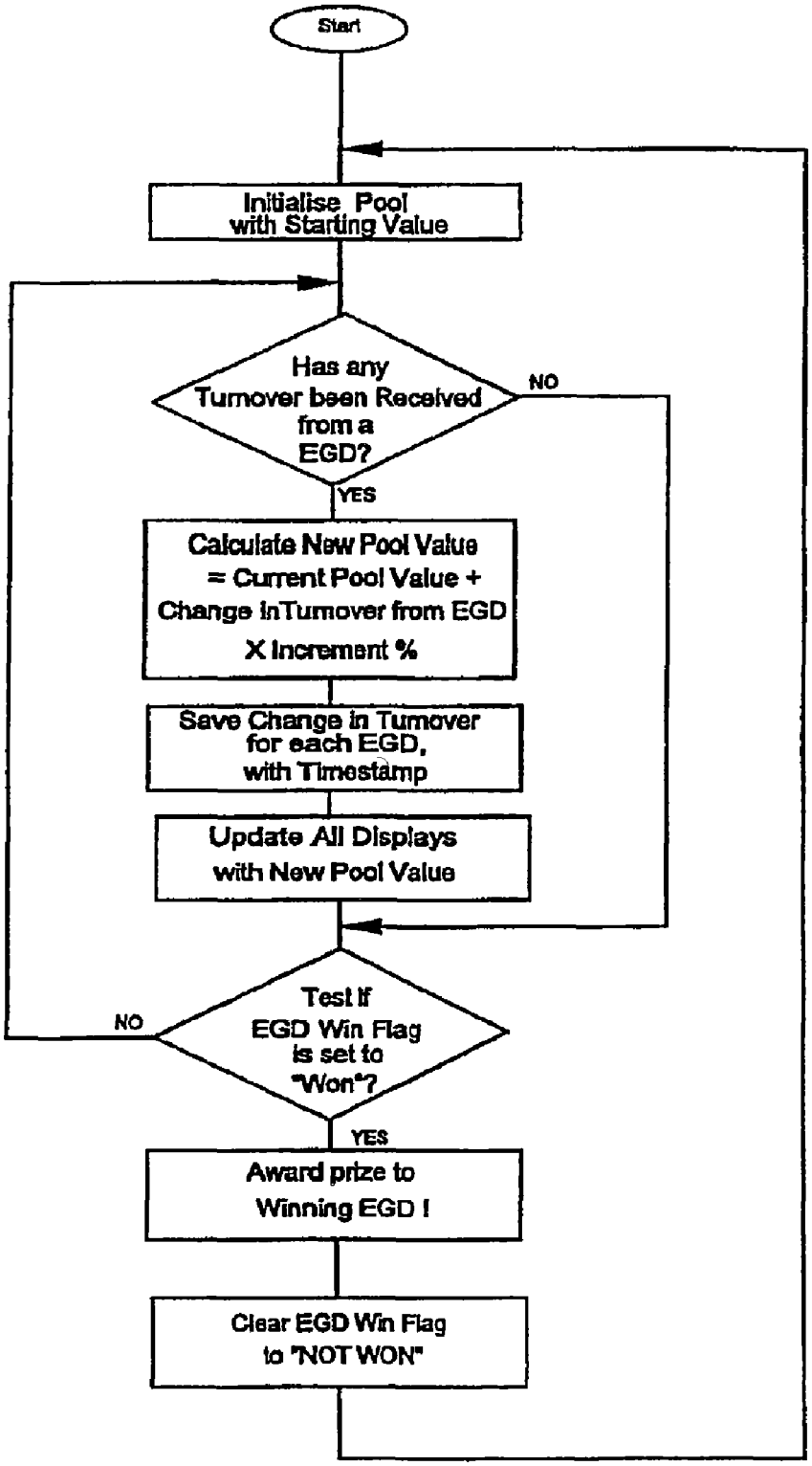
FIG. 2 is a flow chart for the method of jackpot pool calculation.

For the embodiment having the parameters and operational characteristics specified in Table 8 and Table 9, a typical sequence of events for the jackpot would be as follows:

Referring to the flow chart of FIG. 2, the jackpot is started at its reset or starting value ($50.00). Players bet credits on the EGDs, and contribute to the accumulated turnover on each EGD. A percentage of the change in turnover meters of all EGDs since the start of the jackpot is added to the jackpot pool such that after 2 hours of play, the Jackpot would be expected to be worth approximately $75.00 ($50.00+$25.00 from contributions). Any change in turnover meter for each EGD would be recorded as it is calculated in the sliding 30-second time window. All jackpot pool displays are updated with the new value reflecting added contributions from EGDs in play. When the pool has been won, the prize is awarded to the winning EGD and the winning state of the EGD is cleared.

Figure 3:
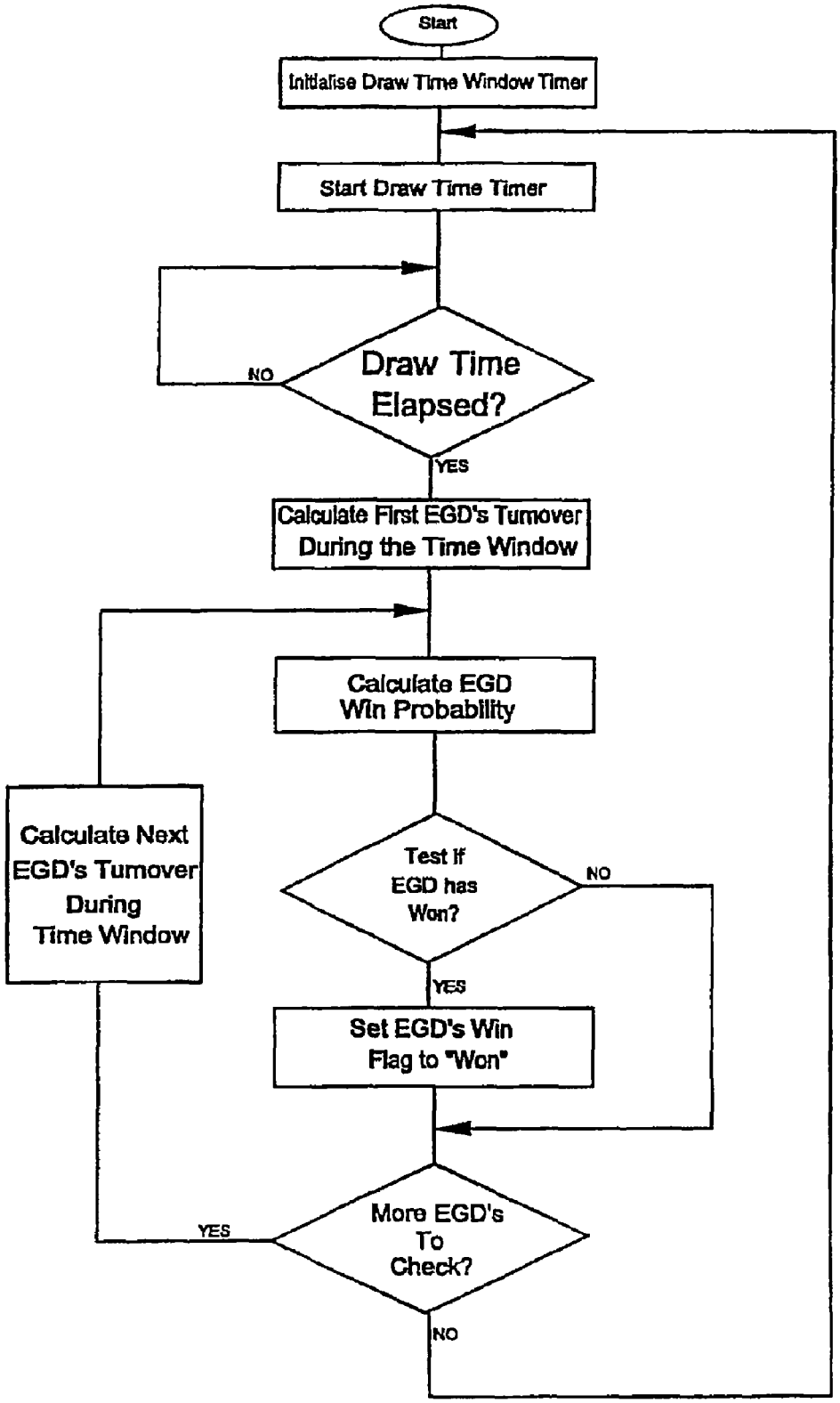
FIG. 3 is a flow chart for the method of determining a jackpot win according to one embodiment.

In parallel with calculating the current jackpot value, the Jackpot Controller 13 conducts jackpot draws. Referring to FIG. 3, a Draw Period window timer is initialized to produce 10-second timeouts, and is started. As each 10-second draw period elapses, the jackpot controller, starting from the first EGD, scans progressively through the EGDs calculating the Scaling Factor for each EGD from (i) change in turnover meter of the respective EGD in the Record Period, i.e. the last 30 seconds and (ii) the number of Draw Periods per Record Period, i.e. 3. Each EGD has a jackpot draw. It is to be noted that the timing of the draws is independent of games played on the EGD. The Scaling Factor is used to determine each EGD's respective probability of winning the jackpot. If the jackpot is won by an EGD, the EGD is placed into a winning state. Each EGD is processed in this manner until all EGDs have been processed.

This process of looking for a winner occurs continuously (every Draw Period) and is independent of the accumulation of the Jackpot Pool. As time since the Jackpot start increases, due to the increasing number of attempts to win the prize, it becomes statistically more likely that the jackpot will be granted. When the jackpot is won, the prize to be paid is held at the current jackpot value, and a new jackpot prize is started. The Jackpot Controller suspends the winning EGD and the winning amount is advertised on the jackpot display. Once the winning value is verified, it is paid to the player of the winning EGD. Payment is preferably credited electronically directly to the EGD that won. After the jackpot is granted to a player, it is reset and continues from the starting value ($50.00).

There are various alternative implementations that achieve the same or similar outcome as the preferred embodiment. For example, the draw could be conducted with a fixed number of attempts, say 10,000 and all attempts occur every draw. The attempts are apportioned to the EGDs based on their relative turnovers over the Record Period.

Further, the probability of winning the jackpot may be based on only some of the amount wagered in the Record Period, such as the maximum bet on any one game in that period, or the amount wagered in the Record Period statistically conditioned to remove abnormally small or large bets.

The calculated probability of a jackpot win can be displayed on the EGD displays 15. These displays can include a graphical indicator that informs the player of the chance of winning the Jackpot, based on average turnover over the Record Period for each EGD. The EGD display may be a rumbling volcano. The higher turnover over time played on the EGD, the fierier the volcano becomes. These displays can be controlled by the jackpot controller so that the volcano erupts on the EGD that wins the prize. Further, a leader board can be shown on an external display 14, that lists the EGDs in order from highest probability of win to lowest. These displays are designed to enhance player appeal and to create atmosphere for the Linked jackpot Game.

In a second preferred embodiment, when an EGD wins a draw, the EGD is informed of the win and instructed to enter a second Screen Feature Game for the purpose of determining the Jackpot Prize to be awarded. At this time, all eligible Jackpot pool values on display are suspended, i.e. held at their current values and no longer visibly increment. Preferably, the display then enters a special "About to win a Jackpot Mode" to heighten excitement. Once the player has completed the second screen feature and the jackpot prize has been determined, the winning EGD informs the Jackpot Controller of the claimed prize. The Jackpot Controller then updates all jackpot pools other than the winning jackpot to their current value (using a percentage of all turnover accumulated since the jackpot values were held). The player is awarded the held value of the winning jackpot and the winning jackpot is reset to the starting value, plus a percentage of any turnover accumulated while the jackpot values were held. Preferably, the Jackpot Display will show a Jackpot Win sequence.

The jackpot win does not terminate the draw processing and it is possible for another EGD to win. Should there be multiple winners, each EGD will be placed into the second Screen Feature to determine the prize. Once the prize is determined, the EGD wins that prize. If multiple EGDs claim the same prize, the first EGD to claim will receive the full jackpot amount on display. The other EGDs that claim the same prize will win the jackpot reset value.

In a variation of this embodiment, multiple EGDs claiming the same prize simultaneously may share the prize.

Figure 4:
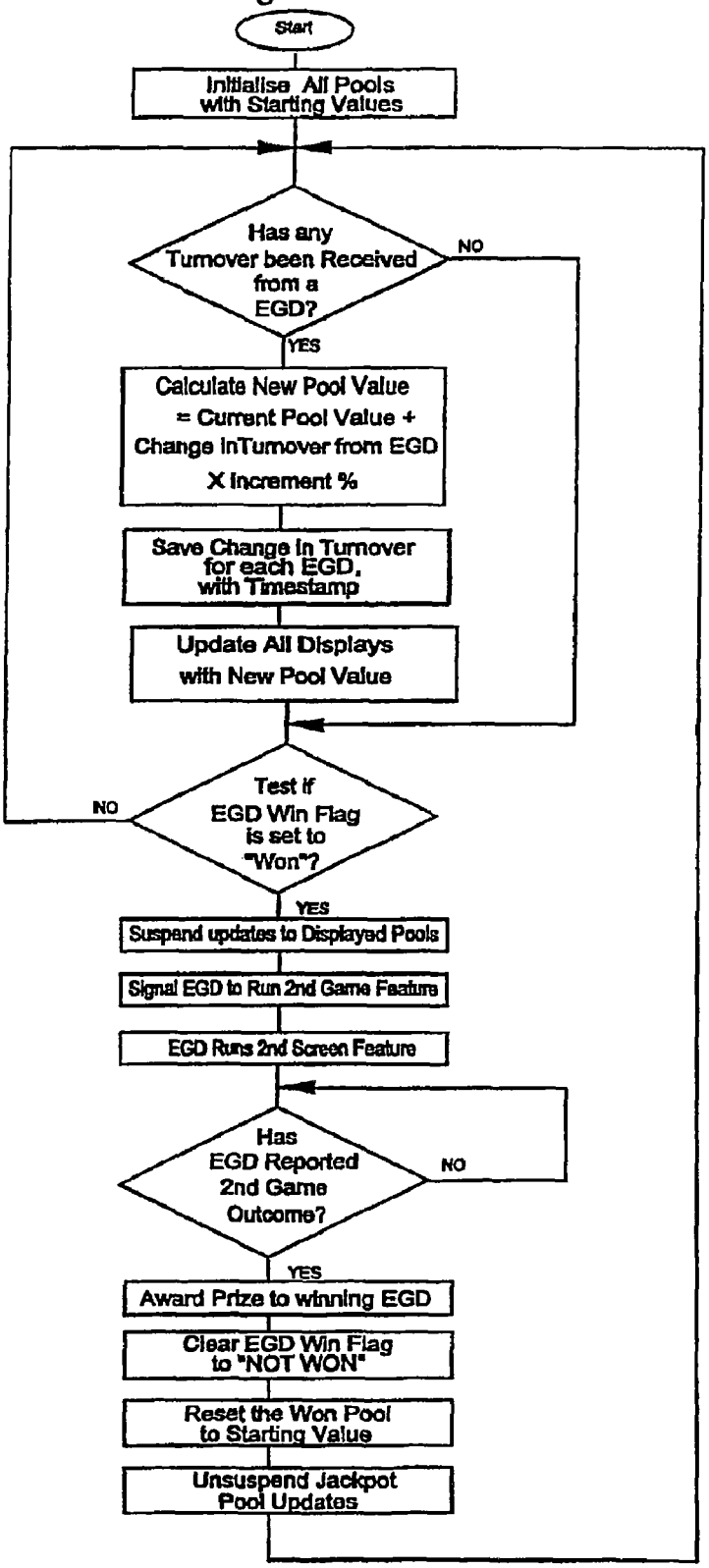
FIG. 4 is a flow chart for the method of calculating jackpot pool and determining jackpot win according to a second embodiment.

A typical sequence of events for this second embodiment is shown in FIG. 4. The jackpots in a group are all reset to their starting values. Players bet credits on the EGDs, and contribute to the accumulated turnover on each EGD. A percentage of the change in turnover since the start of the jackpot is added to the jackpot pool. The change in turnover is recorded in the sliding 30-second time window. All relevant jackpot displays are updated with the new values for each pool. If any EGD wins the pool, the pools are suspended at their current values. The winning EGD is instructed to run a second screen feature game for the purposes of determining the prize to pay. The EGD runs its second screen game as instructed. Once the EGD reports the outcome of the second Screen Game, the claimed prize is paid to the winning EGD. The winning status of the EGD is cleared. The claimed pool is reset to its starting value and all jackpot pools are released and allowed to update based on turnover. Any turnover contributed while the pools were held is added into the pools after they are released.

Various modifications can be made to the foregoing without departing from the scope of the invention. For example, each EGD can maintain its own sliding Record Period and Draw Period, independent of any other EGD in the Jackpot Pool. When an EGD determines that it is going to win, it informs the controller to suspend all jackpots at their current values and presents the second screen feature game to the player automatically. Once the second screen feature game is complete and a prize has been determined, the EGD informs the Jackpot Controller of the determination. The Jackpot Controller then pays the claimed prize to the player and resets it. It also allows the other jackpot pools to increment again, and adds any contributions from turnover that occurred while the pool was suspended.

In a system where the Jackpot Pools may not be suspended due to limitations in the communications network, the second Screen Feature Game can be equipped with a timeout that forces a determination should the player not play within a reasonable time frame. This prevents one player effectively robbing some or all of the subsequent jackpot prize from another player by excessively delaying the claim on the prize pool.

The above described embodiments of a prize awarding system have several advantages over the prior art systems, including:

Each eligible player or gaming machine has the opportunity of winning a prize, with the probability of a win being dependent upon the amount of betting activity on that machine over a recent period, and not just the last game. This provides a fairer outcome as machines with a higher average turnover during that period have a higher win probability than machines with a lower average turnover during the same period even though the latter machines may have had a higher wager on the last game.

The trigger for a draw is not a function of individual games played on a gaming machine. Rather it is a function of time.

Therefore, the prize awarding system may be applied to existing EGDs of differing base denomination, manufacturer or game type without the need for specialized software support from the EGDs. The system can also be operated over existing communication networks and with centralized jackpot systems, including those with high poll latency timings.

Since the prize awarding is non-deterministic, the prizes can be included in the "return to player percentage" of a gaming system, effectively resulting in higher profitability for the operator of the gaming devices.

Prize awarding parameters may be changed by the gaming device operator at any time without any alterations to the hardware, firmware or internal parameters of any of the associated EGDs.

If the awarding of the prize involves a feature game, a fairer outcome is obtained by ensuring that the value of all prize pools is suspended until the completion of the feature game. This prevents players from gaining a financial advantage over subsequent players by delaying the playing of the feature game.

TABLE 1

Recorded Turnover for 30 Seconds

| EGD | Time of Read | Change in Turnover |
|---|---|---|
| 1 | 10:29:20 | $4.35 |
| | 10:29:12 | $5.15 |
| | 10:29:04 | $3.45 |
| | 10:28:58 | $1.05 |
| | TOTAL | $14.00 |
| 2 | 10:29:18 | $0.36 |
| | 10:29:11 | $0.59 |
| | 10:29:04 | $0.47 |
| | 10:28:58 | $0.11 |
| | 10:28:51 | $0.73 |
| | TOTAL | $2.26 |
| 3 | 10:29:19 | $1.10 |
| | 10:29:08 | $0.90 |
| | 10:28:57 | $1.50 |
| | TOTAL | $3.50 |

TABLE 2

Turnover Recorded after a Further 10 Seconds

| EGD | Time of Read | Change in Turnover |
|---|---|---|
| 1 | 10:29:28 | $2.15 |
| | 10:29:20 | $4.35 |
| | 10:29:12 | $5.15 |
| | 10:29:04 | $3.45 |
| | TOTAL | $15.10 |
| 2 | 10:29:25 | $0.94 |
| | 10:29:18 | $0.36 |
| | 10:29:11 | $0.59 |
| | 10:29:04 | $0.47 |
| | TOTAL | $2.36 |
| 3 | 10:29:30 | $2.40 |
| | 10:29:19 | $1.10 |
| | 10:29:08 | $0.90 |
| | TOTAL | $4.40 |

TABLE 3

Discarded Turnover >30 Seconds Old

| EGD | Time of Read | Change in Turnover |
|---|---|---|
| 1 | 10:28:58 | $1.05 |
| 2 | 10:28:58 | $0.11 |
| | 10:28:51 | $0.73 |
| 3 | 10:28:57 | $1.50 |

TABLE 4

Example Scaling Factor Calculations

| Draw Time | EGD# | Total Turnover in Record Period | Draws/Record Period | Scaling Factor |
|---|---|---|---|---|
| 10:29:20 | 1 | $14.00 | 3 | 467 |
| | 2 | $2.26 | 3 | 76 |
| | 3 | $3.50 | 3 | 117 |
| 10:29:30 | 1 | $15.10 | 3 | 504 |
| | 2 | $2.36 | 3 | 79 |
| | 3 | $4.40 | 3 | 147 |

TABLE 5

Variable Probability of Win per Draw per EGD

| Draw Time | EGD# | Scaling Factor | Fixed Base Probability | Variable Win Probability |
|---|---|---|---|---|
| 10:29:20 | 1 | 467 | 0.0003% | 0.1400% |
| | 2 | 76 | 0.0003% | 0.0228% |
| | 3 | 117 | 0.0003% | 0.0351% |
| 10:29:30 | 1 | 504 | 0.0003% | 0.1511% |
| | 2 | 79 | 0.0003% | 0.0237% |
| | 3 | 147 | 0.0003% | 0.0441% |

TABLE 6

Win Band Size for Variable Probabilities with a maximum range of 0-4294967295

| Draw Time | EGD# | Variable Win Probability | Win Band Size |
|---|---|---|---|
| 10:29:20 | 1 | 0.1400% | 0-6012954 |
| | 2 | 0.0228% | 0-979252 |
| | 3 | 0.0351% | 0-1507533 |
| 10:29:30 | 1 | 0.1511% | 0-6489694 |
| | 2 | 0.0237% | 0-1017907 |
| | 3 | 0.0441% | 0-1894080 |

TABLE 7

Assumptions and Desired Configuration of a Jackpot Pool

| | |
|---|---|
| No of EGDs | 10 |
| Average Daily Turnover per EGD | $1500.00 |
| Hours in a Trading Day | 18 |
| Reset Value of the Prize | $50.00 |
| Desired Maximum Value of the Prize | $150.00 |
| Average Increase to RTP % of the connected EGDs | 3% |
| Turnover Sliding Window | 30 Seconds |
| Draw Time | 10 Seconds |

TABLE 8

| Operating Characteristics of this Embodiment | |
|---|---|
| Average Winning Value | $100.00 |
| Average Duration between wins | 4 Hours |
| Win Probability | 0.0003% |
| Pool Increment Rate | 1.5% |
| Minimum of the Winning band for 0.0003% prob. | 0 |
| Maximum of the Winning band for 0.0003% prob. | 12884 |
| Minimum of the Failing band for 0.0003% prob. | 12885 |
| Maximum of the Failing band for 0.0003% prob. | 4294967295 |

The invention claimed is:

1. A method of operating a gaming system, said method comprising:

(a) enabling a plurality of players at a plurality of gaming machines to each place at least one wager on at least one play of a game; and (b) for each of said gaming machines:

(i) for each wagered on play of the game of said gaming machine:

(A) randomly determining a primary game outcome, and (B) causing a display device to display the randomly determined primary game outcome, (ii) monitoring a first amount of wagers placed on said gaming machine during a first period of time, (iii) for each wagered on play of the game of said gaming machine during the first period of time, determining a first probability of winning a designated award for the first period of time, wherein said determined first probability is based, at least in part, on the monitored first amount of wagers placed during the first period of time and the first probability is determined regardless of any amounts of wagers placed at any of said other gaming machines;

(iv) causing said gaming machine to display and provide the designated award if a first determination occurs to provide the designated award, wherein said first determination is associated with the first period of time, based on the determined first probability and is separate from randomly determining any primary game outcomes, (v) monitoring a second amount of wagers placed on said gaming machine during a second, subsequent period of time, wherein the second time period partially overlaps the first period of time such that at least one wager on at least one game is placed at a point in time that is during the first period of time and the second period of time, (vi) for each wagered on play of the game of said gaming machine during the second period of time, determining a second probability of winning the designated award for the second period of time, wherein said determined second probability is based, at least in part, on the monitored second amount of wagers placed during the second period of time and the second probability is determined regardless of any amounts of wagers placed at any of said other gaming machines; and (vii) causing said gaming machine to display and provide the designated award if a second determination occurs to provide the designated award, wherein said second determination is associated with the second period of time, is based on the determined second probability and is separate from randomly determining any primary game outcomes.

2. The method of claim 1, which includes determining a different second probability of winning the designated award for the second period of time if the second amount of wagers placed during the second period of time is different than the first amount of wagers placed during the first period of time.

3. The method of claim 1, wherein for each of said gaming machines, determining the first probability of winning the designated award for the first period of time is based, at least in part, on a first quantity of designated award draws during the first period of time and the monitored first amount of wagers placed during the first period of time.

4. The method of claim 3, wherein for each of said gaming machines, determining the second probability of winning the designated award for the second period of time is based, at least in part, on a second quantity of designated award draws during the second period of time and the monitored second amount of wagers placed during the second period of time.

5. The method of claim 1, wherein the designated award is a progressive award.

6. The method of claim 1, wherein the designated award is one of a plurality of progressive awards.

7. A method of operating a gaming system, said method comprising:

(a) enabling a plurality of players at a plurality of gaming machines to each place at least one wager on at least one play of a game; and (b) for each of said gaming machines:

(i) for each wagered on play of the game of said gaming machine:

(A) randomly determining a primary game outcome, and (B) causing a display device to display the randomly determined primary game outcome, (ii) monitoring a first amount of wagers placed on said gaming machine during a first period of time, (iii) causing said gaming machine to display and provide a designated award if a first determination occurs to provide the designated award, wherein said first determination is associated with the first period of time is based on a first probability of winning the designated award for the first period of time and is separate from randomly determining any primary game outcomes, wherein said first probability is based, at least in part, on the monitored first amount of wagers placed during the first period of time and the first probability is independent of any amounts of wagers placed at any of said other gaming machines, (iv) monitoring a second amount of wagers placed on said gaming machine during a second, subsequent period of time, wherein the second time period partially overlaps the first period of time such that at least one wager on at least one game is placed at a point in time that is during the first period of time and the second period of time, and (v) causing said gaming machine to display and provide the designated award if a second determination occurs to provide the designated award, wherein said second determination is associated with the second period of time, is based on a second probability of winning the designated award for the second period of time and is separate from randomly determining any primary game outcomes, wherein said second probability is based, at least in part, on the monitored second amount of wagers placed during the second period of time and the second probability is independent of any amounts of wagers placed at any of said other gaming machines.

8. The method of claim 7, wherein the second probability of winning the designated award for the second period of time is different than the first probability of winning the designated award for the first period of time if the second amount of wagers placed during the second period of time is different than the first amount of wagers placed during the first period of time.

9. The method of claim 7, wherein for each of said gaming machines, the first probability of winning the designated award for the first period of time is based, at least in part, on a first quantity of designated award draws during the first period of time and the monitored first amount of wagers placed during the first period of time.

10. The method of claim 9, wherein for each of said gaming machines, the second probability of winning the designated award for the second period of time is based, at least in part, on a second quantity of designated award draws during the second period of time and the monitored second amount of wagers placed during the second period of time.

11. The method of claim 7, wherein the designated award is a progressive award.

12. The method of claim 7, wherein the designated award is one of a plurality of progressive awards.

13. A method of operating a gaming system, said method comprising:

(a) for each of a plurality of plays of a primary game of a first gaming machine during a first period of time:
  (i) enabling a player to wager one of a plurality of different wager amounts on said play of the primary game, and
  (ii) for said play of the primary game:
    (A) randomly determining a primary game outcome,
    (B) causing a display device to display the randomly determined primary game outcome,
    (C) determining a primary game award, said determined primary game award based on the determined primary game outcome and which of the plurality of different wager amounts was wagered on, and
    (D) causing the display device to display the determined primary game award;

(b) separate from determining any primary game awards during the first period of time:
  (i) determining a first probability of the first gaming machine awarding a prize, said first probability determined based, at least in part, on the amounts wagered during the first period of time, said first probability determined regardless of any amounts wagered at any other gaming machine during the first period of time, and
  (ii) determining whether to cause the first gaming machine to award the prize, said determination based on the determined first probability; and (c) for each of a plurality of plays of the primary game of the first gaming machine during a second period of time which partially overlaps the first period of time and includes a point in time in which one of the plays of the primary game is included in both the first period of time and the second period of time:
  (i) enabling the player to wager one of the plurality of different wager amounts on said play of the primary game, and
  (ii) for said play of the primary game:
    (A) randomly determining a primary game outcome,
    (B) causing the display device to display the randomly determined primary game outcome,
    (C) determining a primary game award, said determined primary game award based on the determined primary game outcome and which of the plurality of different wager amounts was wagered on, and
    (D) causing the display device to display the determined primary game award;

(d) separate from determining any primary game awards during the second period of time:
  (i) determining a second probability of the first gaming machine awarding the prize, said second probability determined based, at least in part, on the amounts wagered during the second period of time, said second probability determined regardless of any amounts wagered at any other gaming machine during the second period of time, and
  (ii) determining whether to cause the first gaming machine to award the prize, said determination based on the determined second probability; and (e) if any determination is to cause the first gaming machine to award the prize to the player:
  (i) causing the display device to display the prize, and
  (ii) providing the prize to the player.

14. The method of claim 13, which includes conducting a prize draw for each of the first and second periods of time and, prior to each prize draw, determining the probability of the first gaming machine winning that draw to be awarded the prize.

15. The method of claim 14, wherein the draws are conducted at periodic intervals of time, the period between draws being no greater than a predetermined period of time.

16. The method of claim 15, wherein at least one of the determined first and second probabilities is determined from an estimated amount wagered on the first gaming machine during the period of time since the last draw, the estimated amount being determined on a pro rata basis from the recorded amount of wagers during the predetermined period of time.

17. The method of claim 14, wherein the prize is a play of a further game to determine an award to be provided to the player.

18. The method of claim 17, wherein the time allowed for playing the further game is limited to a predetermined period.

19. The method of claim 17, wherein the award is a jackpot.

20. The method of claim 13, wherein the prize is a jackpot pool.

21. The method of claim 20, wherein the jackpot pool comprises an initial amount and a proportion of the amount wagered on at least the first gaming machine since the jackpot pool was reset.

22. The method of claim 13, further comprising the step of displaying a graphical representation of at least one of the determined probabilities of the first gaming machine awarding the prize.

23. The method of claim 22, wherein the gaming system includes a plurality of gaming machines, and the probabilities are displayed in relative format.

* * * * *

UNITED STATES PATENT AND TRADEMARK OFFICE

CERTIFICATE OF CORRECTION

PATENT NO. : 8,118,664 B2
APPLICATION NO. : 12/978772
DATED : February 21, 2012
INVENTOR(S) : Steven Brian Johnson It is certified that error appears in the above-identified patent and that said Letters Patent is hereby corrected as shown below:

IN THE CLAIMS:

In Claim 1, Column 11, Line 44, before “based” add --is--.

In Claim 1, Column 11, Line 49, replace “time period” with --period of time--.

In Claim 7, Column 12, Line 42, between “time” and “is” add --,--.

In Claim 7, Column 12, Line 53, replace “time period” with --period of time--.

Signed and Sealed this
Eighth Day of May, 2012

David J. Kappos

David J. Kappos
*Director of the United States Patent and Trademark Office*